US008081055B2

(12) United States Patent
Lo

(10) Patent No.: US 8,081,055 B2
(45) Date of Patent: Dec. 20, 2011

(54) INDUCTIVE ELEMENT HAVING A GAP AND A FABRICATION METHOD THEREOF

(75) Inventor: Peng Chen Lo, Taipei (TW)

(73) Assignee: Magic Technology Co., Ltd., Jhonghe (TW)

( * ) Notice: Subject to any disclaimer, the term of this patent is extended or adjusted under 35 U.S.C. 154(b) by 108 days.

(21) Appl. No.: 12/555,953

(22) Filed: Sep. 9, 2009

(65) Prior Publication Data

US 2011/0001601 A1 Jan. 6, 2011

(30) Foreign Application Priority Data

Jul. 3, 2009 (TW) ..... 98122728 A

(51) Int. Cl.
*H01F 27/24* (2006.01)

(52) U.S. Cl. ..... 336/212; 336/216

(58) Field of Classification Search ..... 336/212, 336/216

See application file for complete search history.

(56) References Cited

U.S. PATENT DOCUMENTS 2,699,532 A * 1/1955 Bussing ..... 336/100
3,622,307 A * 11/1971 Clarke, Jr. ..... 420/49
3,686,561 A * 8/1972 Spreadbury ..... 323/308
3,720,897 A * 3/1973 Feather et al. ..... 336/60
4,163,884 A * 8/1979 Kobetsky ..... 219/633
4,409,523 A * 10/1983 Yasumura ..... 315/371
5,378,966 A * 1/1995 Marszalik ..... 315/411
6,031,441 A * 2/2000 Yen ..... 336/96
6,414,583 B1 * 7/2002 Yeh et al. ..... 336/200
6,512,438 B1 * 1/2003 Yoshimori et al. ..... 336/178
6,980,078 B2 * 12/2005 Rouser ..... 336/216
7,804,390 B2 * 9/2010 Kosugi et al. ..... 336/208
7,859,379 B2 * 12/2010 Uemura ..... 336/92

* cited by examiner

*Primary Examiner* — Anh Mai
*Assistant Examiner* — Joselito Baisa
(74) *Attorney, Agent, or Firm* — Pearne & Gordon LLP

(57) ABSTRACT

An inductive element having a gap and a fabrication method thereof are disclosed. The fabrication method is for fabricating an inductive element having a first core body, a second core body and a gap, and includes: coating an adhesive on a gap-facing side of the first core body and/or the second core body; providing a linear spacer and installing the linear spacer between the first core body and the second core body; and combining the side of the first core body where the adhesive is coated with the side of the second core body where the adhesive is coated, allowing the linear spacer to form the gap when the first core body is combined with the second core body. Thereby, the linear spacer establishes the size of the gap of the inductive element and improves the adhesion of the first core body to the second core body.

8 Claims, 6 Drawing Sheets

INDUCTIVE ELEMENT HAVING A GAP AND A FABRICATION METHOD THEREOF

BACKGROUND OF THE INVENTION

1. Field of the Invention

This invention relates to an inductive element having a gap and a fabrication method thereof, and more particularly, to an inductive element that uses a linear spacer to control the size of the gap and a fabrication method thereof.

2. Description of Related Art

An inductive element is a passive element in an electronic circuit. An inductive element typically comprises a magnetic core and a coil. In electronic circuits, inductive element come in a variety of types depending on the desired attributes. One type of inductive element is an inductive element having a gap. Compared to an inductive element without a gap, an inductive element having a gap has a coil that is installed on a ferrite element to thereby provide lower inductance and greater current. The gap prevents the inductive element from entering the saturation state and becoming useless when current flows through the inductive element.

For a general inductive element having a gap, the larger the gap, the smaller the inductance of the inductive element becomes, and vice versa. Therefore, the inductive element may be manufactured to the desired inductance by controlling the size of the gap.

FIG. 1 is a perspective diagram of an inductive element 1 having a low inductance and high current-carrying capability according to the prior art. The inductive element 1 comprises an upper core body 11, a tape 12, an adhesive 14, a lower core body 15 and a coil 16. In fabrication, the adhesive 14 is covered on the lower core body 15, tape 12, which can endure high temperatures, is stuck to the upper core body 11, and then the upper core body 11 that is affixed with the tape 12 covers the lower core body 15 covered with the adhesive 14. The upper core body 11 is spaced apart from the lower core body 15 by the tape 12 of a predetermined thickness to form a gap, and is adhered to the lower core body 15 by the adhesive 14. In order for the upper core body 11 to be at a uniform distance from the lower core body 15 (i.e., the size of the gap), the tape 12 is fabricated to have a large surface area, and is applied to the contact surface between the upper core body 11 and the lower core body 15.

Therefore, such an inductive element 1 uses the tape 12 to establish the size of the gap, and the thicker the tape 12, the lower the inductance of the inductive element 1 becomes.

However, the inductive element of the prior art has the following drawbacks.

(1) The tape has too large an area in contact with the core bodies. As shown in FIG. 1, the large area occupied by the tape 12, which is used in order for the gap to have a uniform size, covers a significant portion of the side of the upper core body 11 that contacts the adhesive 14, such that the adhesive 14 cannot maximally adhere the upper core body 11 to the lower core body 15, leaving the upper core body 11 easily detachable from the lower core body 15.

(2) Use of the tape has low accuracy. As formerly stated, the inductance of the inductive element is affected by the gap size, and the gap of the inductive element has to have a uniform size. However, the tape used in the prior art has too large a tolerance (that is, the difference in the thickness of the tape at various places), so the inductive element does not have a uniform inductance.

(3) The inductive element of the prior art incurs high costs. There is a limited number of types of high-temperature endurable tapes in the market, so most users order their own dedicated tapes, which costs a lot of money, and the inductive element that uses such tapes have a correspondingly higher cost.

In conclusion, finding a way to provide an inductive element that can more accurately, securely and cheaply form the gap, and do so in a way that can tolerate the high temperatures encountered in manufacture or application, is an important goal in the art.

SUMMARY OF THE INVENTION

In view of the above-mentioned problems of the prior art, the present invention provides a fabrication method for fabricating an inductive element having a gap. The fabrication method is for fabricating an inductive element having a first core body, a second core body and the gap, and includes the steps of: (1) coating an adhesive on a gap-facing side of the first core body and/or the second core body; (2) providing a linear spacer and installing the linear spacer between the first core body and the second core body; and (3) combining the side of the first core body where the adhesive is coated with the side of the second core body where the adhesive is coated, allowing the linear spacer to form the gap when the first core body is combined with the second core body.

In an embodiment of the present invention, the fabrication method further includes the step (4) providing at least two elastic elements and installing the elastic elements on two opposite sides of the inductive element, respectively, for fixing in position the first core body, the linear spacer and the second core body adhering to one another.

In another embodiment of the present invention, the step (4) further includes baking the inductive element fixed in position by the elastic elements, cooling the inductive element after the inductive element is baked, and removing the elastic elements after the inductive element is cooled.

The present invention further provides an inductive element having a gap. In an embodiment of the present invention, the inductive element includes a first core body; a second core body; and at least a linear spacer installed between first core body and the second core body for forming the gap when the first core body is combined with the second core body.

In an embodiment of the present invention, the inductive element further includes an adhesive coated on the first core body and/or the second core body for being filled into the gap when the first core body is combined with second core body, such that the first core body is adhered to the second core body.

In another embodiment of the present invention, the linear spacer is made of a metal that can endure a temperature as high as 125 degrees Celsius, and has its cross section all along its length have the same area.

In yet another embodiment of the present invention, the first core body and/or the second core body is in the shape of the letter "E", "I" or "H".

Therefore, in an inductive element having a gap and a fabrication method thereof according to the present invention, since the linear spacer, which is used for forming the gap, has a low cost, a small area of contact with the core bodies, and high accuracy, the drawbacks of the prior art are thus overcome.

DETAILED DESCRIPTION OF PREFERRED EMBODIMENTS

The following illustrative embodiments are provided to illustrate the disclosure of the present invention, these and other advantages and effects being readily understandable by those in the art after reading the disclosure of this specification. The present invention can also be performed or applied by other embodiments. The details of the specification may be on the basis of specific viewpoints and applications, and numerous modifications and variations can be devised without departing from the spirit of the present invention.

Figure 1:
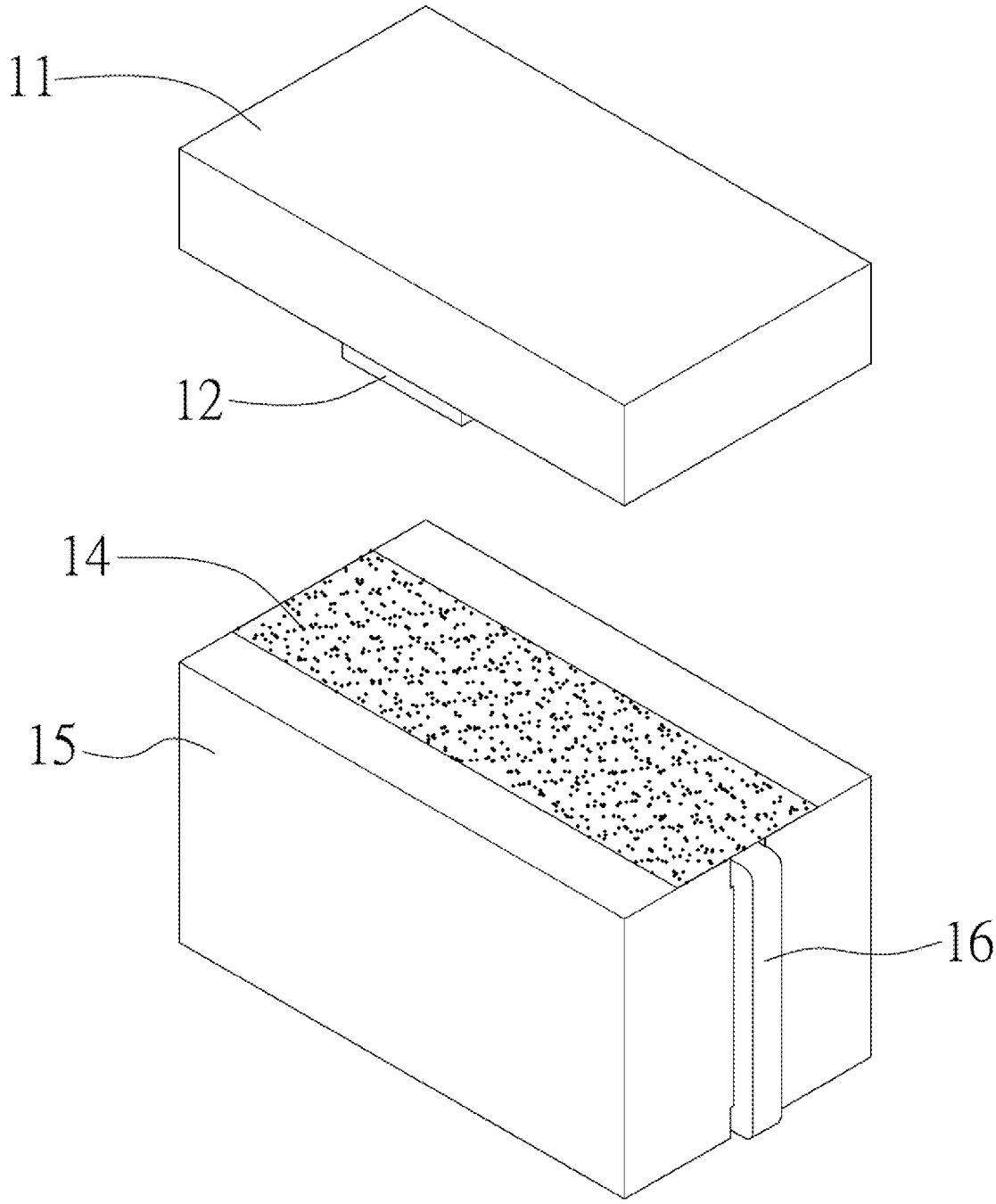
FIG.1 (PRIOR ART)
FIG. 1 is a perspective diagram of an inductive element that takes a planar tape as a spacer according to the prior art.
Figure 2:
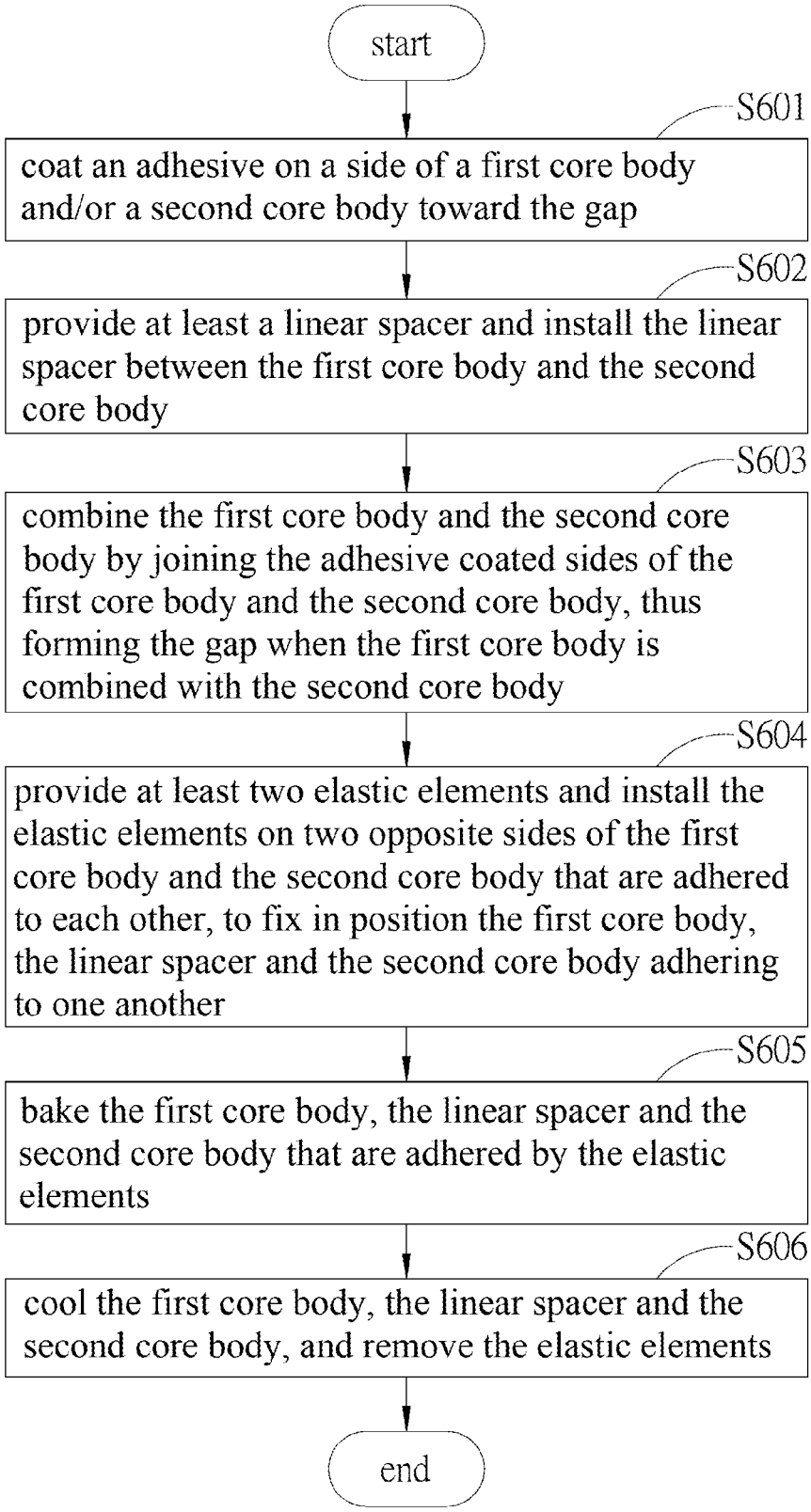
FIG. 2 is a flow chart of a fabrication method for an inductive element having a gap according to the present invention.

FIG. 2 is a flow chart of a fabrication method for an inductive element having a gap according to an embodiment of the present invention. Note that only the steps that relate to the present invention are shown in FIG. 2, further steps hereby being omitted for clarity.

As shown in FIG. 2, the fabrication method for an inductive element having a gap according to the present invention includes the following steps.

In step S601, an adhesive is coated on a gap-facing side of a first core body and/or a second core body. The adhesive is a thermosetting adhesive, thermoplastic adhesive, silicone adhesive or epoxy adhesive. In the embodiment, the adhesive is for adhering the first core body to the second core body. The present invention neither limits the amount of the adhesive used nor limits the first or second core body coated with the adhesive. Next, proceed to step S602.

In step S602, at least a linear spacer is provided and is installed between the first core body and the second core body. In an embodiment of the present invention, the linear spacer has its cross section all along its length to have the same area, and has a round cross section perpendicular to the direction in which it extends. In other words, the linear spacer has a slim linear body that has a uniform radius from an initial end to a terminal end, and can be easily fabricated in various sizes. The linear spacer is made of a metal capable of enduring a temperature as high as 135±10 degrees Celsius. Preferably, the linear spacer is a copper wire. In the embodiment, at least a linear spacer is installed between the first core body and the second core body. Preferably, two linear spacers are installed between the first core body and the second core body. Next, proceed to step S603.

In step S603, the side of the first core body where the adhesive is coated is correspondingly combined with the side of the second core body where the adhesive is coated on. The word "correspondingly" herein means that the first core body and the second core body correspond in shape to each other when combined. For example, if both the first core body and the second core body are in the shape of the letter "E", the first core body and the second core body are combined in a mouth-to-mouth manner. The linear spacer allows a gap to be formed between the first core body and the second core body when the first core body is combined correspondingly with the second core body. Next, proceed to step S604.

In step S604, at least two elastic elements such as clamps are provided and installed on two opposite sides of the first core body and the second core body, to fix in position the first core body, the linear spacer and the second core body adhering to one another. Therefore, the first core body, the linear spacer and the second core body are clamped by the forces applied by the clamps in the direction perpendicular to the gap. Next, proceed to step S605.

In step S605, the first core body, the linear spacer and the second core body that are adhered by the two clamps (the elastic elements) are baked in an oven at a temperature of 135±10 degrees Celsius for 30 minutes. Next, proceed to step S606.

In step S606, after the first core body, the linear spacer and the second core body have been removed from the baking equipment, the first core body, the linear spacer and the second core body that are adhered by the two clamps (elastic elements) are cooled for 30 minutes and then the elastic elements are removed, thus completing the fabrication process of the inductive element having the gap.

The above embodiments of the present invention disclose an inductive element that is fabricated by the fabrication method for an inductive element having a gap, wherein a first core body and a second core body that are adhered to each other firmly form a gap using a linear spacer that has a small surface area in contact with the cores. Moreover, since the linear spacer has its cross section all along its length to have the same area, the gap formed by the linear spacer has an accurate size. Further, since the linear spacer of the invention is easily fabricated to any size and has a low fabrication cost, an inductive element that includes the linear spacer can have a lower fabrication cost.

Figure 3A:
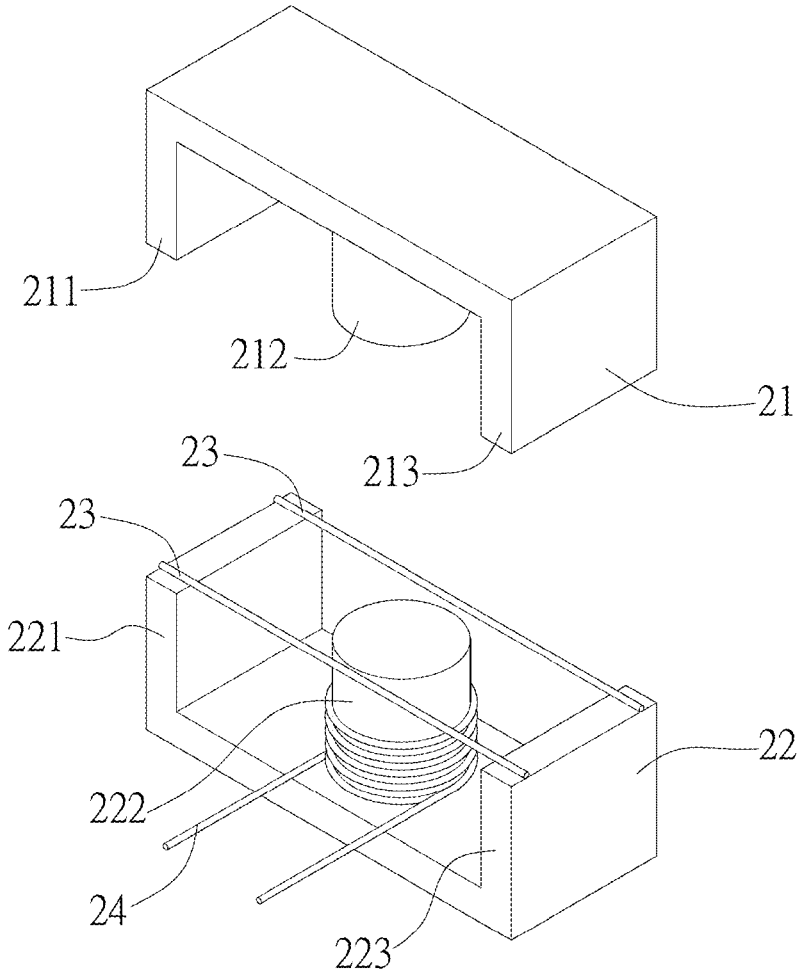
FIG. 3A is a perspective diagram of an "E"-shaped inductive element having a gap according to an embodiment to the present invention.

FIG. 3A is a perspective diagram of an "E"-shaped inductive element 2 having a gap 25 according to the present invention. The inductive element 2 comprises a first core body 21, a second core body 22, a linear spacer 23 (which may be split) and a coil 24.

The first core body 21 and the second core body 22 are made of a magnetic material and, preferably, are each a ferrite core or a magnetic core. As shown in FIG. 3A, both the first core body 21 and the second core body 22 are in the shape of the letter "E". The coil 24 of the inductive element 2 is installed in an intermediate portion 222 of the center member of the "E"-shaped second core body 22. In another embodiment of the present invention, the coil 24 encircles an intermediate portion 212 of the "E"-shaped first core body 21 and the intermediate portion 222 of the "E"-shaped second core body 22.

Figure 3B:
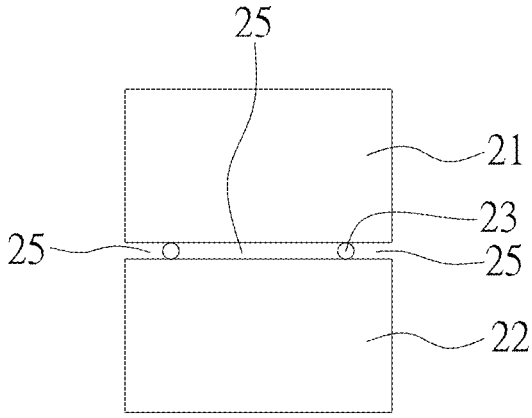
FIG. 3B is a side view of the inductive element shown in FIG. 3A.

Referring to FIG. 3B, which is a side view of the inductive element 2 shown in FIG. 3A, the linear spacer 23 is installed between the first core body 21 and the second core body 22. Since the linear spacer 23 occupies a substantive space, the installation of the linear spacer 23 leads to the formation of a gap 25 between the first core body 21 and the second core body 22 when the first core body 21 is combined with the second core body 22. In an embodiment of the present invention, the linear spacer 23 has its cross section all along its length maintain the same area. In other words, the linear spacers 23 has the same thickness (diameter/thickness/height) from an initial end to a terminal end. In the embodiment shown in FIGS. 3A and 3B, the linear spacer 23 has a round cross section that is perpendicular to the direction in which the linear spacer 23 extends. In other words, the linear spacer 23 has a slim linear body. Such a design allows the opposite sides of the first core body 21 and the second core body 22 to be parallel when the first core body 21 is combined with the second core body 22, and reduces the contact area between the linear spacer 23 and the first and second core bodies 21, 22.

Since the inductive element is baked at a temperature of 135±10 degrees Celsius, the linear spacer 23 is made of a metal capable of enduring a temperature as high as 125 degrees Celsius. In an embodiment of the present invention, the linear spacer 23 is made of copper. Preferably, the linear spacer 23 is a copper wire.

Note that since the linear spacer 23 is used for establishing a space between the first core body 21 and the second core body 22 to form the gap 25 when the first core body 21 is combined with the second core body 22; however, the amount and arrangement of the linear spacer 23 are not limited to the embodiment shown in FIGS. 3A and 3B.

The inductive element 2 further comprises an adhesive (not shown). During the fabrication of the inductive element 2, the adhesive is coated on a first portion 211 and a second portion 213 of the "E"-shaped first core body 21 and on a first portion 221 and a second portion 223 of the "E"-shaped second core body 22 after the coil 24 is installed in the intermediate portion 222 of the "E"-shaped second core body 22. Then, the linear spacer 23 is installed on a side of the second core body 22 where the adhesive is coated, such that the linear spacer 23 is installed across the first portion 211 and the second portion 213 of the first core body 21. The first core body 21 is then combined with the second core body 22, such that the first core body 21 and the second core body 22 are adhered to each other when the first core body 21, which is spaced apart from the second core body 22 by the linear spacer 23, is combined with the second core body 22.

It can be discerned from the above embodiments that the linear spacer 23 is for establishing a space between the first core body 21 and the second core body 22 to form the gap 25 when the first core body 21 is combined with the second core body 22. Since the linear spacer 23 is made of metal and metal has good ductility, the linear spacer 23 can be fabricated to have a uniform size from the head to the tail, and can be cut into a plurality of segments of the same radius. Therefore, during the fabrication of the inductive element 2 shown in FIGS. 3A and 3B, a plurality of inductive elements having gaps of the same size can be obtained, since the linear spacer 23 has a highly accurate size. Given the small contact area between the linear spacer 23 and the first and second core bodies 21, 22, the adhesive covers relatively large areas of the first core body 21 and the second core body 22 of the inductive element 2 according to the present invention, as compared with the inductive element of the prior art. Accordingly, the adhesion between the first core body 21 and the second core body 22 is greatly improved.

The linear spacer, which is made of a copper wire, for example, is easily fabricated to any size (radius) with high accuracy and low costs. In general, the copper wire is a conductive material and is used as a coil of the inductive element. In an embodiment of the present invention, the copper wire is used as the linear spacer of the present invention, for leaving a space between the first core body and the second core body to form the gap. Accordingly, the inductive element having the linear spacer (e.g., the copper wire) has a low cost.

Compared with the inductive element of the prior art, which uses planer tape as the spacer, the inductive element of the present invention, which uses the copper wire as the linear spacer, has a low cost, high gap accuracy, and good adhesion between the first core body and the second core body.

Figure 4:
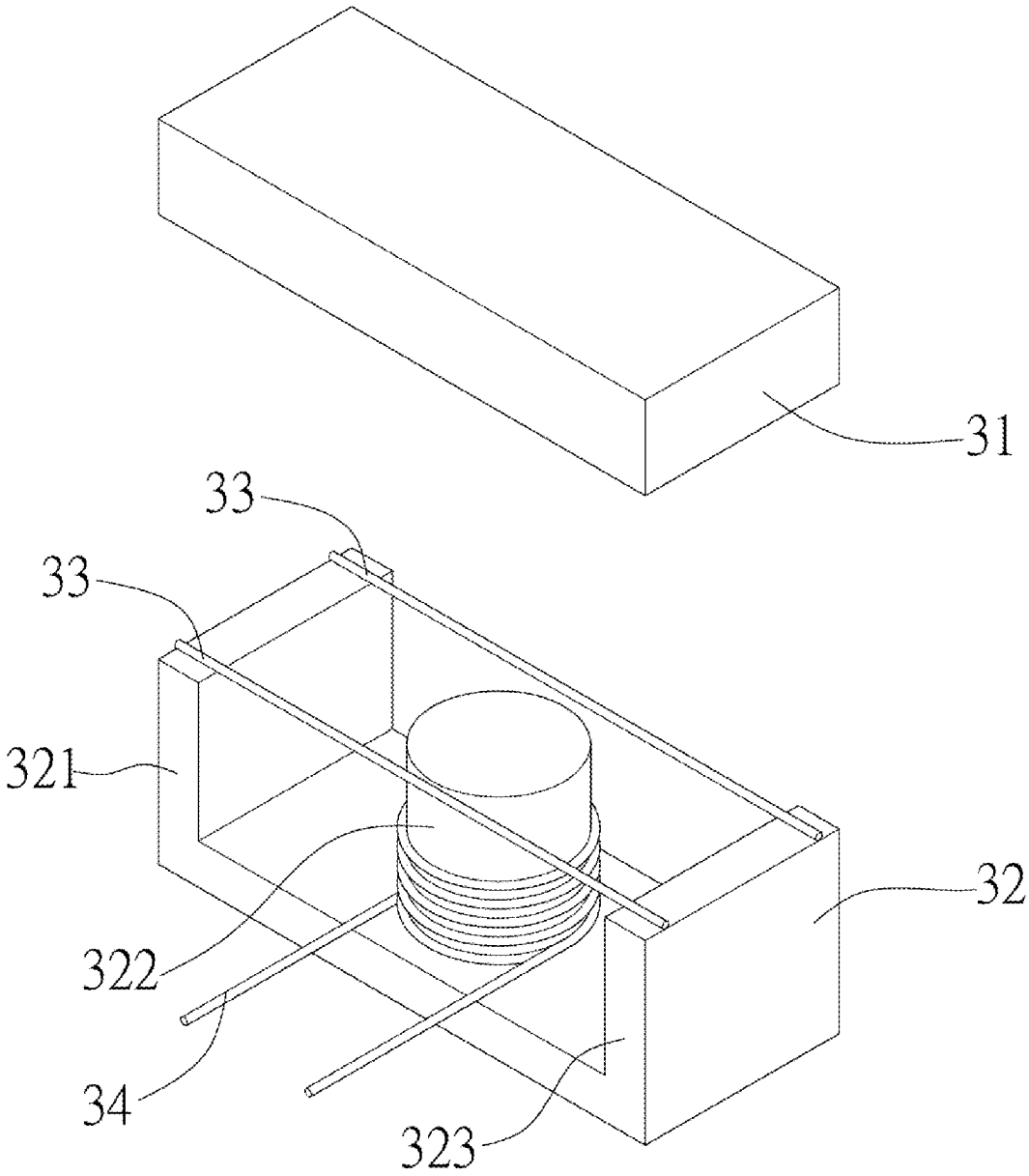
FIG. 4 is a perspective diagram of an "E"-shaped inductive element having a gap according to another embodiment the present invention.
Figure 5:
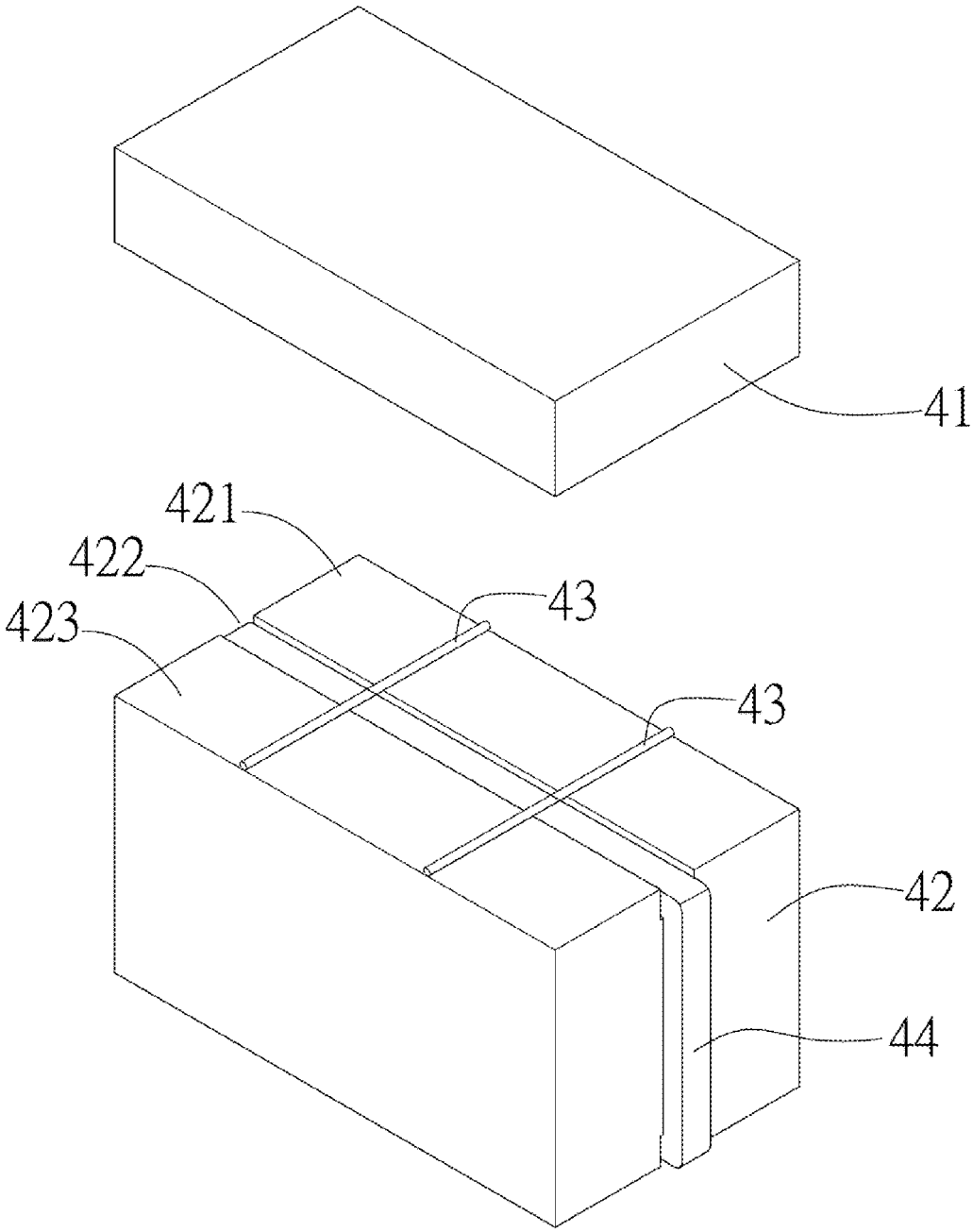
FIG. 5 is a perspective diagram of an "H"-shaped inductive element having a gap according to the present invention.
Figure 6:
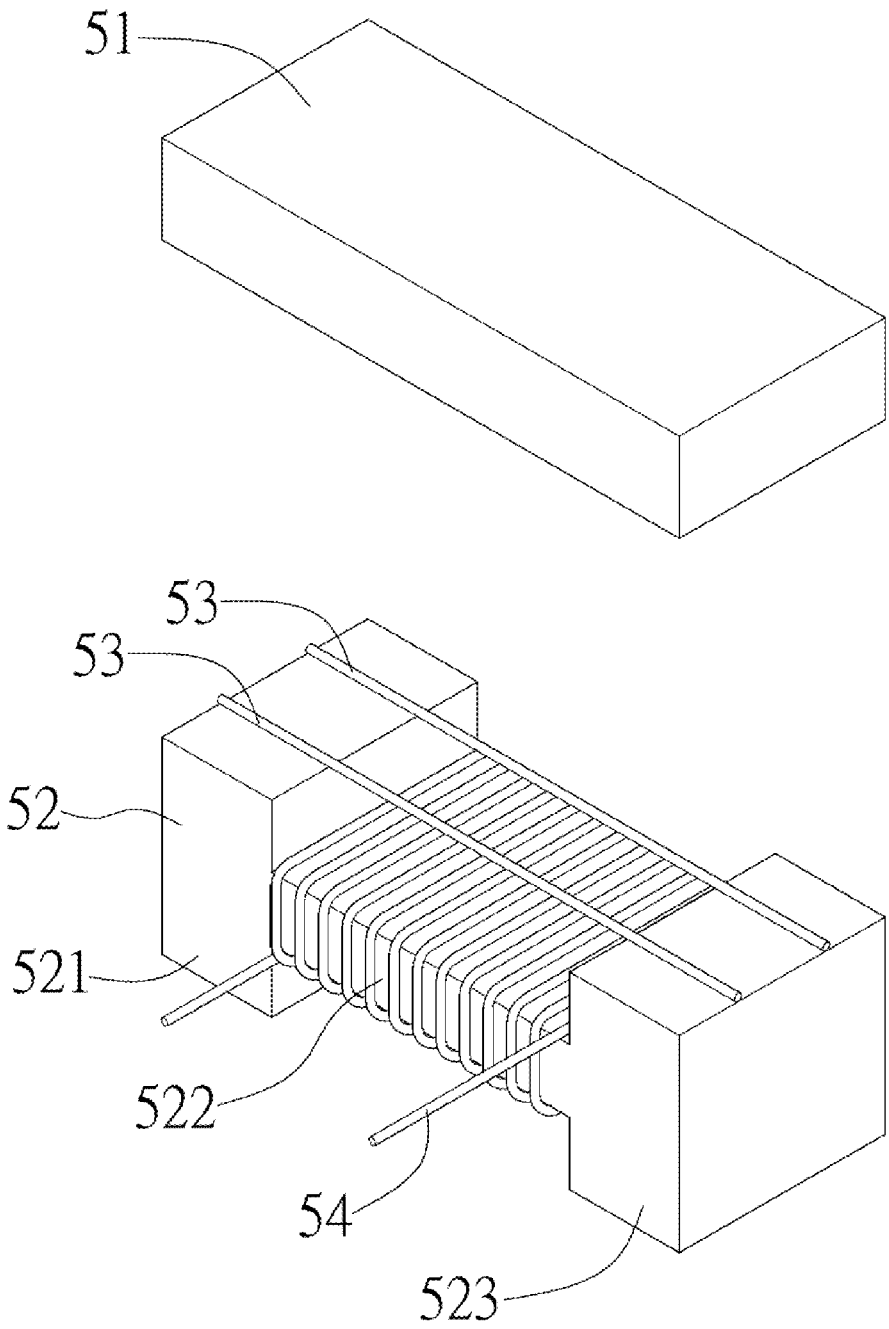
FIG. 6 is a perspective diagram of an "I"-shaped inductive element having a gap according to the present invention.

Referring to FIGS. 4-6, there are shown perspective diagrams of an inductive element having a gap of various embodiments according to the present invention. The inductive elements shown in FIGS. 4-6 has the same basic components as the inductive element shown in FIGS. 3A and 3B, so only the differences between the inductive elements are described in the following paragraphs.

As shown in FIG. 4, which is a perspective diagram of an inductive element 3 having a gap of another embodiment according to the present invention, the inductive element 3 comprises a first core body 31, a second core body 32, a linear spacer 33, a coil 34 and an adhesive (not shown). The first core body 31 is rectangular, while the second core body 32 is in the shape of the letter "E". The coil 34 of the inductive element 3 is installed at an intermediate portion 322 of the "E"-shaped second core body 32. The adhesive is coated on a first end portion 321 and a second end portion 323 of the second core body 32. The linear spacer 33 is installed between the first core body 31 and the second core body 32 and installed across the first end portion 321 and the second end portion 323 of the second core body 32, to form a gap when the first core body 31 is combined with the second core body 32, allowing the first core body 31, the linear spacer 33 and the second core body 32 to be adhered to one another.

FIG. 5 is an inductive element 4 having a gap of yet another embodiment according to the present invention. A first core body 41 is rectangular, and a second core body 42 is in the shape of the letter "H". A coil 44 of the inductive element 4 is installed in an intermediate portion 422 of the "H"-shaped second core body 42. An adhesive (not shown) is coated on a first portion 421 and a second portion 423 of the second core body 42. A linear spacer 43 is installed across the first portion 421 and the second portion 423 of the second core body 42. Alternatively, the linear spacer 43 is installed on the first portion 421 and the second portion 423 of the second core body 42, respectively.

FIG. 6 is an inductive element 5 having a gap of yet another embodiment according to the present invention. A first core body 51 is rectangular, and a second core body 52 is in the shape of the letter "I". A coil 54 of the inductive element 5 is installed at an intermediate portion 522 of the "I"-shaped second core body 52. An adhesive (not shown) is coated on the first end portion 521 and the second end portion 523 of the second core body 52. A linear spacer 53 is installed across the first portion 521 and the second portion 523 of the second core body 52. Alternatively, the linear spacer 53 is installed on the first end portion 521 and the second end portion 523 of the second core body 52, respectively.

FIGS. 4-6 differ only in the shape of the core bodies of the inductive element ("E"-shaped, "H"-shaped or "I"-shaped). As was the case with the first embodiment, a linear spacer controls the size of the gap of the inductive element, and the installation of the linear spacer between the first core body and the second core body forms the gap when the first core body is combined with the second core body.

In conclusion, an inductive element having a gap according to the present invention has the following advantages:

(1) The contact area between the linear spacer and the core bodies is small, allowing the first core body to be firmly adhered to the second core body. Since the adhesive is coated on the gap-facing side of the first core body and/or the second core body, and the linear spacer is installed between the first core body and the second core body, the small contact area between the linear spacer and the core bodies allows the first core body and the second core body to have a large adhesion area, and thus improves the adhesion between the first core body and the second core body.

(2) The linear spacer has a constant thickness, such that the size of the gap of the inductive element created by the linear spacer is accurately established with little variance. Since the linear spacer has its cross section all along its length have the same area and be perpendicular to the direction in which it is extended, the segments formed by cutting the linear spacer in a direction perpendicular to the extension direction also have the same size (that is, the tolerance between the segments is small). Thus, the gap formed by the installation of the linear spacer between the first core body and the second core body when the first core body is combined with the second core body has an accurate size. The linear spacer not only controls the size of the gap of the inductive element, it also ensures the uniformity of the size of the gap of the inductive element.

(3) The linear spacer incurs low costs. Accordingly, an inductive element that is fabricated with the linear spacer can have a lower cost than what might otherwise be possible. Since the linear spacer is easily fabricated to have a desired size, and there are many linear spacers of various sizes in the market, an inductive element that is fabricated with a linear spacer of a predetermined size can be manufactured at a reduced cost. The foregoing descriptions of the detailed embodiments are provided to illustrate and disclose the features and functions of the present invention and are not intended to be restrictive of the scope of the present invention. It should be understood by those in the art that many modifications and variations can be made according to the spirit and principle in the disclosure of the present invention and still fall within the scope of the invention as set forth in the appended claims.

What is claimed is:

1. An inductive element having a gap, comprising:

a first core body;

a second core body; and at least a linear spacer installed between the first core body and the second core body for forming the gap when the first core body is combined with the second core body such that the first core body is separated from the second core body.

2. The inductive element of claim 1 further comprising an adhesive coated on the first core body and/or the second core body for being filled into the gap when combining the first core body and the second core body, to thereby adhere the first core body to the second core body.

3. The inductive element of claim 2, wherein the adhesive is a thermosetting adhesive, thermoplastic adhesive, silicone adhesive or epoxy adhesive.

4. The inductive element of claim 1, wherein the linear spacer is a copper wire.

5. The inductive element of claim 1, wherein the linear spacer has a round cross section perpendicular to the direction in which the linear spacer extends.

6. The inductive element of claim 1, wherein the linear spacer has its cross section all along its length maintain the same area and be perpendicular to the direction in which the linear spacer extends.

7. The inductive element of claim 1, wherein the first core body or the second core body is made of a magnetic material.

8. The inductive element of claim 1, wherein the first core body or the second core body is in the shape of the letter "E", "I" or "H".

* * * * *